US005581864A

United States Patent [19]

Rabet

[11] Patent Number: 5,581,864

[45] Date of Patent: Dec. 10, 1996

[54] COKE DRUM DEHEADING SYSTEM

[75] Inventor: Nobby Rabet, Fort McMurray, Canada

[73] Assignee: Suncor, Inc., North York, Canada

[21] Appl. No.: 433,981

[22] Filed: May 4, 1995

[30] Foreign Application Priority Data

Jan. 17, 1995 [CA] Canada ..... 2140380

[51] Int. Cl.[6] ..... B23P 19/00

[52] U.S. Cl. ..... 29/426.3; 29/426.5; 29/252; 202/241; 202/252

[58] Field of Search ..... 29/426.1, 426.3, 29/426.5, 402.03, 708, 822, 823, 252; 202/241, 242, 252

[56] References Cited

U.S. PATENT DOCUMENTS 4,726,109 2/1988 Malsbury et al. ..... 29/402.08
4,960,358 10/1990 DiGiacomo et al. ..... 202/241
5,098,524 3/1992 Antalfy et al. ..... 202/96
5,336,375 8/1994 Wallskog et al. ..... 202/252
5,500,094 3/1996 Fruchtbaum et al. ..... 202/241

*Primary Examiner*—David P. Bryant
*Attorney, Agent, or Firm*—Paul Lipsitz

[57] ABSTRACT

An apparatus and method enabling safe removeal of the drum head of a coking drum. The invention provides an apparatus remotely placing a carriage under the drum head and the carriage is adapted to remotely engage the drum head, tightly support the head against the drum while workers are in the area, and to lower the head and carry it away. Included in the system is a safety feature wherein the carriage is normally supported by springs which in the event of excessive load automatically transfers the load carrier to an overhead beam designed to carry any excessive loads.

10 Claims, 10 Drawing Sheets

COKE DRUM DEHEADING SYSTEM

BACKGROUND OF THE INVENTION

This invention relates to a novel system to safely remove the bottom head of a coking drum under the most severe load conditions.

In the operation of delayed coking systems where coking of various hydrocarbon streams is carried out, the coke formed is deposited on the inner walls of the drum and is periodically removed. To remove the coke it is necessary to remove the bottom head unit by removing the bolts attaching it to a flange on the vertical coking drum and then attaching a chute to the bottom of the drum to direct the removed coke to a storage area or to a railroad car. This operation is hazardous for several reasons:

a) Cooling water which is introduced into the hot drums prior to the removal of the bottom head becomes extremely hot and could leak from the loosened head and scald workers in the area.

b) The load of undrained water and loose coke within the drum may exceed the limits of the support system and cause heavy equipment to fall on workers.

c) Positioning of the chute and necessary removal of flanges is done with workers at risk to the conditions of a and b.

The present invention provides a novel and safe system for deheading the coking drum without the hazards indicated above.

SUMMARY OF THE INVENTION

This invention provides a safe system to remove the head from a coking drum by operating the removal procedure at a remote location. In brief, the remote system of the invention provides an apparatus for remotely placing a carriage under the head of the coking drum wherein the carriage has means to remotely control engagement of the drum head and means to tightly support the head against the flange on the drum as the last bolts are removed, lower the head when desired and then laterally carry the head away from the opening. In the event of excess load, however, the normal carriage support system is automatically overridden through a spring system and support for the excess load is transferred to a separate system supported by overhead beams which are designed to carry such excess weight. Thus, in the event of an overload while workers are in the area, such as during the removal of the final bolts from the head, there can be no collapse of any equipment which could harm personnel. Further, the head support system achieved by the carriage assures that no hot water leakage can occur while workers are in the area. Additional embodiments of the invention provide:

(1) means for automatically lifting of a chute cover located at floor level beneath the coking drum and for remotely raising the chute to the bottom of the drum and (2) means for remotely separating a flange on the coker charge pipe to permit lowering of the head, thus avoiding the use of workers in the area to manually provide the necessary separation.

DESCRIPTION OF PRIOR ART

U.S. Pat. No. 4,726,109 (Malsbury et al) discloses a device for remotely unheading delayed coking drums wherein the head unit is adapted for fastening to the lower flange of a coking drum; pivotal clamping means and bolt detensioning; means for unfastening a plurality of bolts in the flange and swinging the bolts radically outward and upwardly so as to permit downward removal of the head unit; a vertically movable platform means adapted for support and lowering the head unit from the drum flange and moving it laterally to a side position, and piston means for tipping the head unit through an angle of 20°–60° with the horizonal plane for cleaning. The device also includes a chute attached to the lower side of the platform so that the chute is raised to contact the coker drum flange. There is no disclosure of the spring system of subject invention which automatically provides the means necessary to support a weight overload.

U.S. Pat. No. 5,098,524 (Antoily et al) discloses a coke drum unheading system employing hydraulic cylinders mounted on the coke drum which are remotely controlled to hold the drum head in a closed or open position which system is designed to handle heavy loads. There is no disclosure of the system of the invention using the novel spring system to automatically engage in the event of an overload.

DETAILED DESCRIPTION OF THE INVENTION

Figure 1:
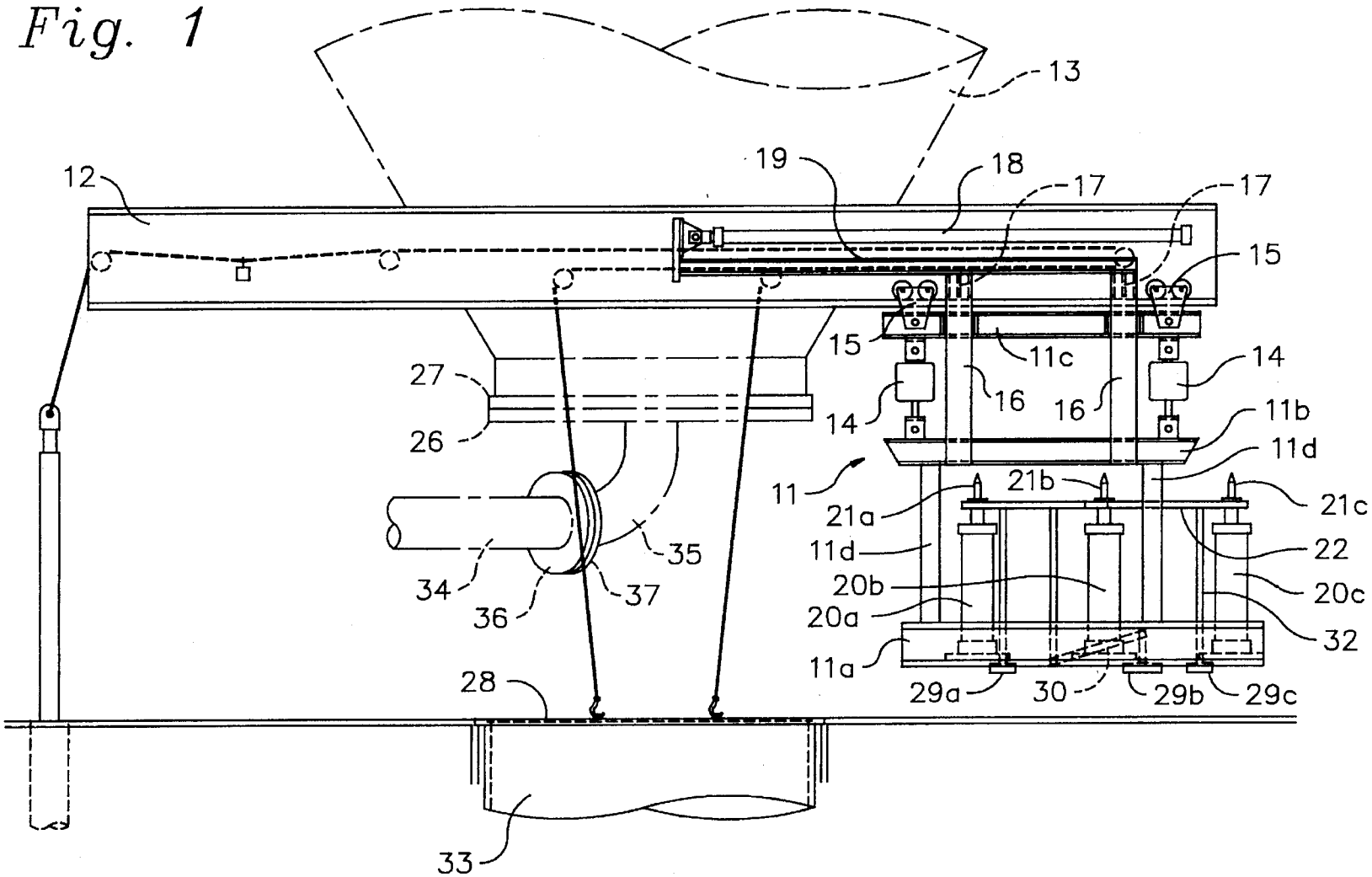
FIG. 1 is an elevation view of the apparatus wherein the carriage is in a position retracted from the bottom of a coking vessel.
Figure 2:
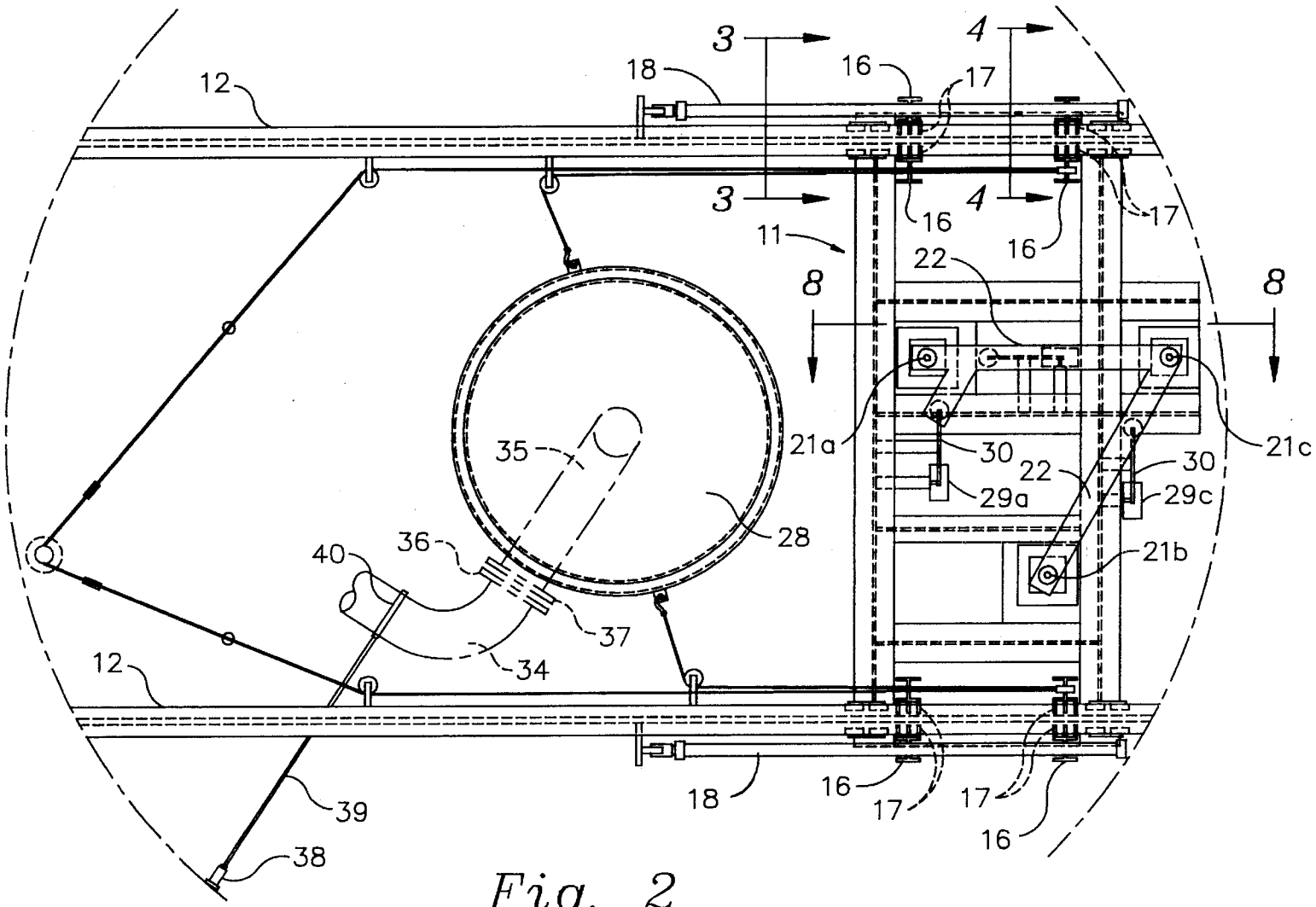
FIG. 2 is plan view showing the carriage in a retracted position.

Referring to FIGS. 1 and 2, the system of the invention comprises a carriage assembly shown generally as 11 suspended from overhead I beams 12 surrounding the coking drum shown in phantom as 13. The carriage 11 is made from steel beams and as shown in FIG. 1 is comprised of horizontal beams 11*a*, 11*b*, and 11*c*, and vertical beams 11*d*. Springs 14 and end trucks or trolleys 15 comprise a normal support system for the carriage assembly shown in more detail in FIG. 3. Vertical beams 16 attached to beam 11*b* of the carriage are fitted at their top ends with safety stops 17 which are shown in more detail in FIGS. 4 and 5. When supporting only the weight of the bottom head and normal coke load, the entire carriage assembly will be lifted by the spring support system 14 so that safety stops 17 ride approximately one-half inch above the main support beams 12. Under these normal conditions the carriage load is supported by the trolleys 15 which travel along the lower flange of main support beams 12. The carriage load when suspended by the stops 17 on the overhead beams 12 is rated at a load significantly higher (about 75 tons) than the normal load supported by the end trucks (about 10 tons).

When supporting normal loads, the carriage is moved back and forth on beam 12 while suspended on the trolleys 15 by a transport system, preferably comprised of remotely operated hydraulic cylinders 18 mounted on support beams 12 and attached to carriage 11 by a bar 19. The carriage 11 is equipped with at least three and preferably three remotely operated head lift cylinders 20*a*, 20*b*, and 20*c* arranged triangularly which have a load capacity about equal to the carriage and its load (about 75 tons) when supported by the overhead beams. The pistons 21*a*, 21*b*, and 21*c* of the lift cylinders are supported by stabilizer channels 22, and pointed to engage bolt holes in the drum head 26 and these pistons are positioned in the bolt holes just prior to removing the last of the bolts holding the drum head 26 to the flange 27 at the bottom of the drum 13 shown in FIG. 7. The head lift cylinders push up with sufficient force to overcome the spring force and cause the safety stops 17 to make direct contact with the main support beams 12 prior to removing the last bolts. The hydraulic system incorporates flow dividers to ensure that the cylinders travel at the same speed and the cylinders also have holding valves to prevent the head from dropping if hydraulic flow pressure is lost.

Also shown in FIG. 1, but in more detail in FIGS. 8 to 10 and which will be discussed later is an optional system to raise a chute cover 28 located at floor level beneath the coking drum which comprises three triangularly arranged electromagnets on a frame shown as 29*a*, 29*b*, and 29*c* which are mounted under the bottom of the carriage, which magnets can be raised and lowered by levers 30 connected to the stabilizer channels 22 thru telescoping pipes 32.

Figure 11:
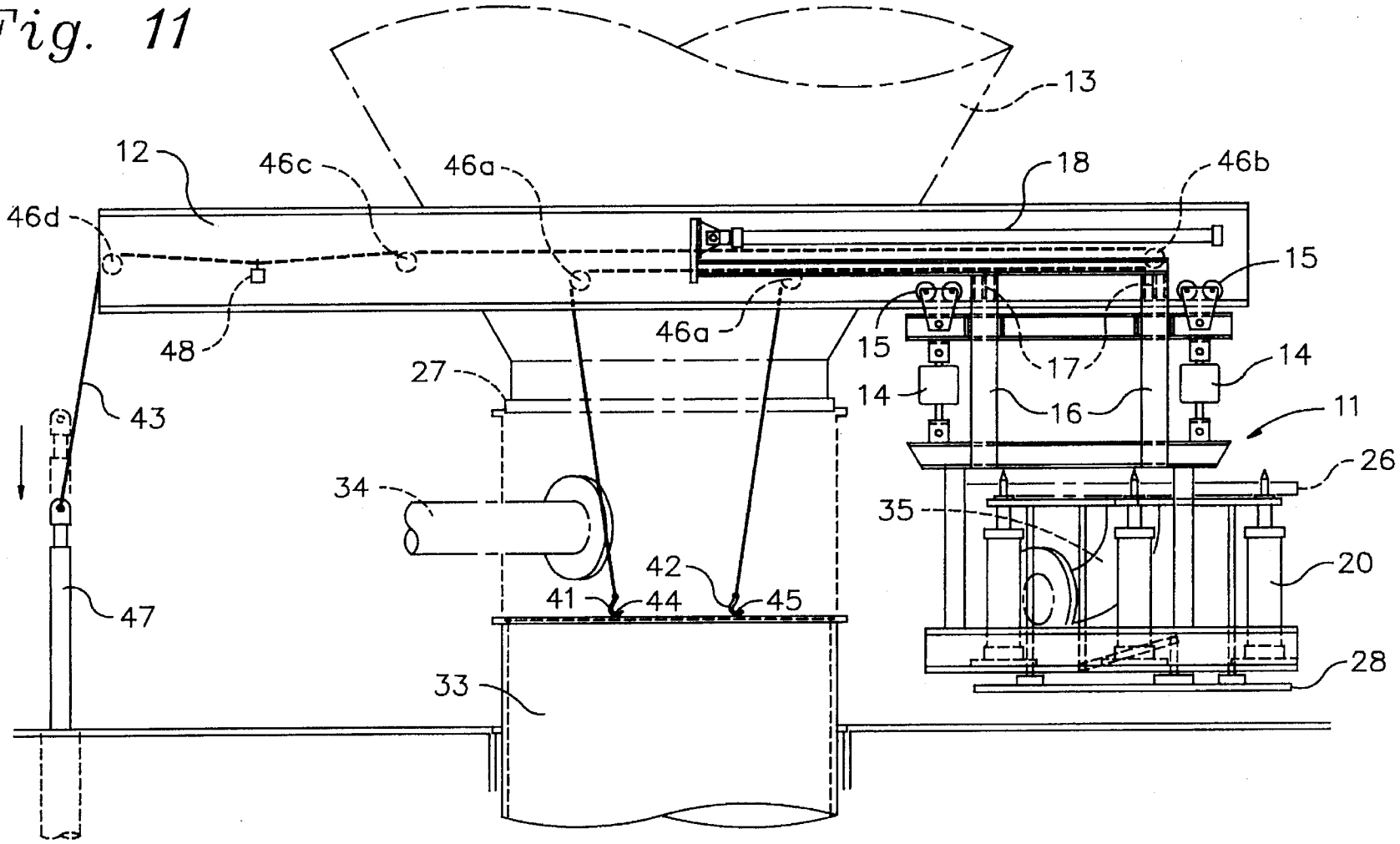
FIG. 11 is an elevational view showing the chute lifting system.
Figure 12:
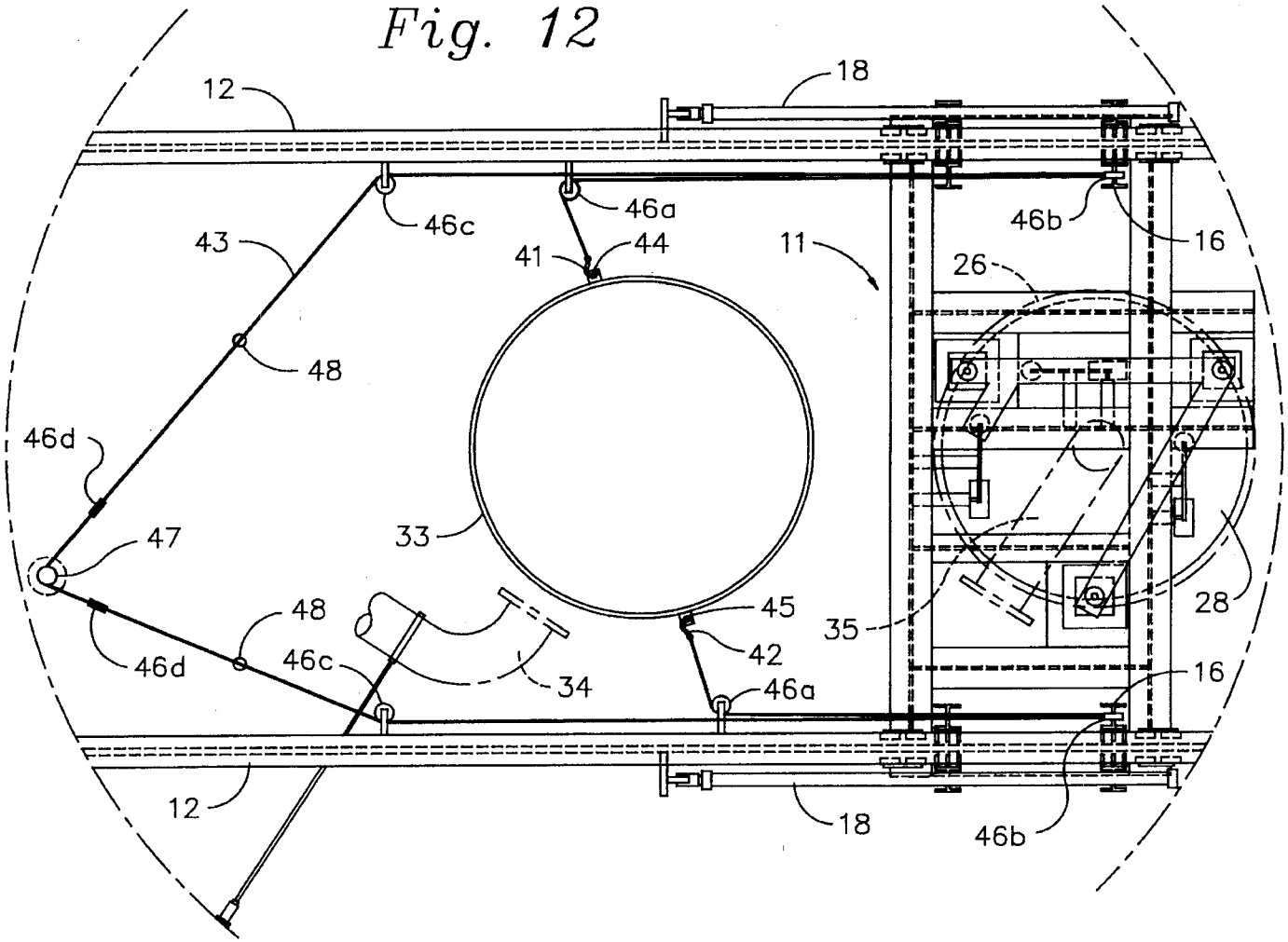
FIG. 12 is a planar view showing the chute lifting system.

In another optional embodiment of the invention, a chute 33 is lifted by a wire rope rigging system shown in detail in FIGS. 11 and 12 which is used to raise and lower the recessed chute 33 to and from the bottom of the open drum 13.

Still another optional embodiment of the invention discussed later is a remote flange spreader system wherein charging line 34 is separated from elbow 35 which is attached to drum head 26 (see FIGS. 1 and 2).

Figure 5:
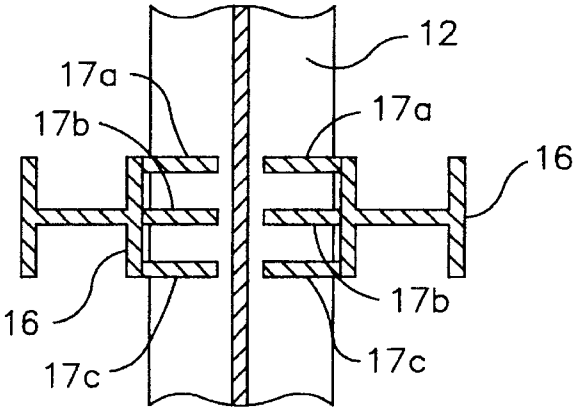
FIG. 5 is a planar view of the safety stops.
Figure 4:
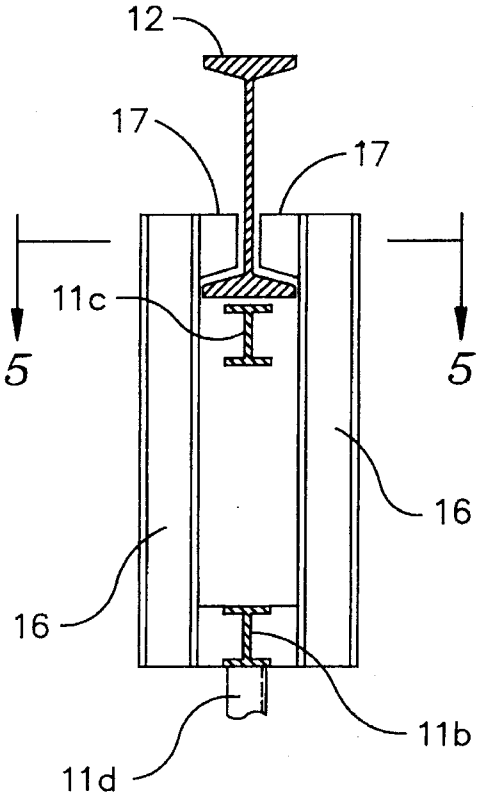
FIG. 4 is a view of the safety system.
Figure 3:
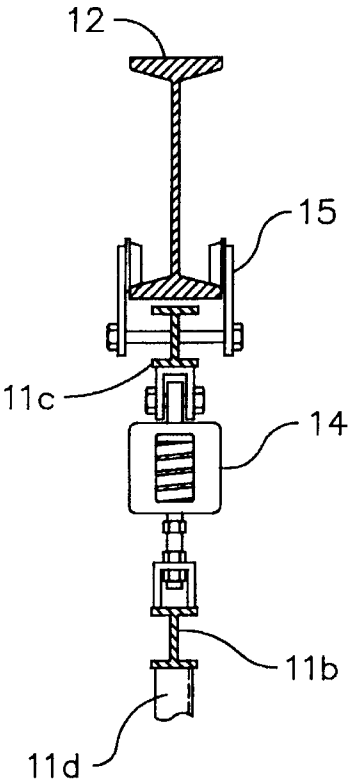
FIG. 3 is a view of the spring hanger system under normal conditions.

As indicated above, the carriage 11 is fitted with a normal suspension system, as well as a separate, safety support system. FIG. 3 taken on lines 3—3 of FIG. 2 shows in more detail the spring system 14 and how the trolleys 15 ride on beam 12 in the normal support system. FIG. 4, taken on line 5—5 of FIG. 2 shows the overload support system in detail comprised of vertical supporting beams 16 whose upper ends have one or more safety stops 17 overlapping the lower flange of overhead supporting beam 12 wherein the safety stops 17 rest on the lower flange of overhead support beam 12 .When the load exceeds about 10 tons the springs 14 will no longer carry the weight and the carriage will drop to cause the stops to directly contact beam 12 which can support about 75 tons. FIG. 5 taken on line 5—5 of FIG. 4 shows the preferred arrangement of three fingers 17*a*, 17*b*, and 17*c* comprising the stops affixed to vertical beam 16. Safety stop configurations other than the three fingers as shown may also be used.

Considering now, the head removal procedure, after the quench water is added to the hot coke in the drum and the water is drained, as is done in the conventional operation for coke removal, the head bolts are removed except for about nine bolts left in groups of three each around the head, but making sure that the bolt holes to be engaged by pistons 21*a*, 21*b*, and 21*c* are open. The bolts are also removed from the charge line flanges 36 and 37 (FIG. 1) so that the elbow 35 of the coke charge line attached to the drum head 26 (FIG. 1) can be separated from the coke charge line elbow 34 to provide room for removal of the drum head 26 with its attached elbow. This flange separation system is shown in detail in FIG. 2 where a remotely operated hydraulic cylinder 38 is attached to one end of a rod 39 which, in turn, has at its other end a collar 40 fastened to elbow 34.

Figure 6:
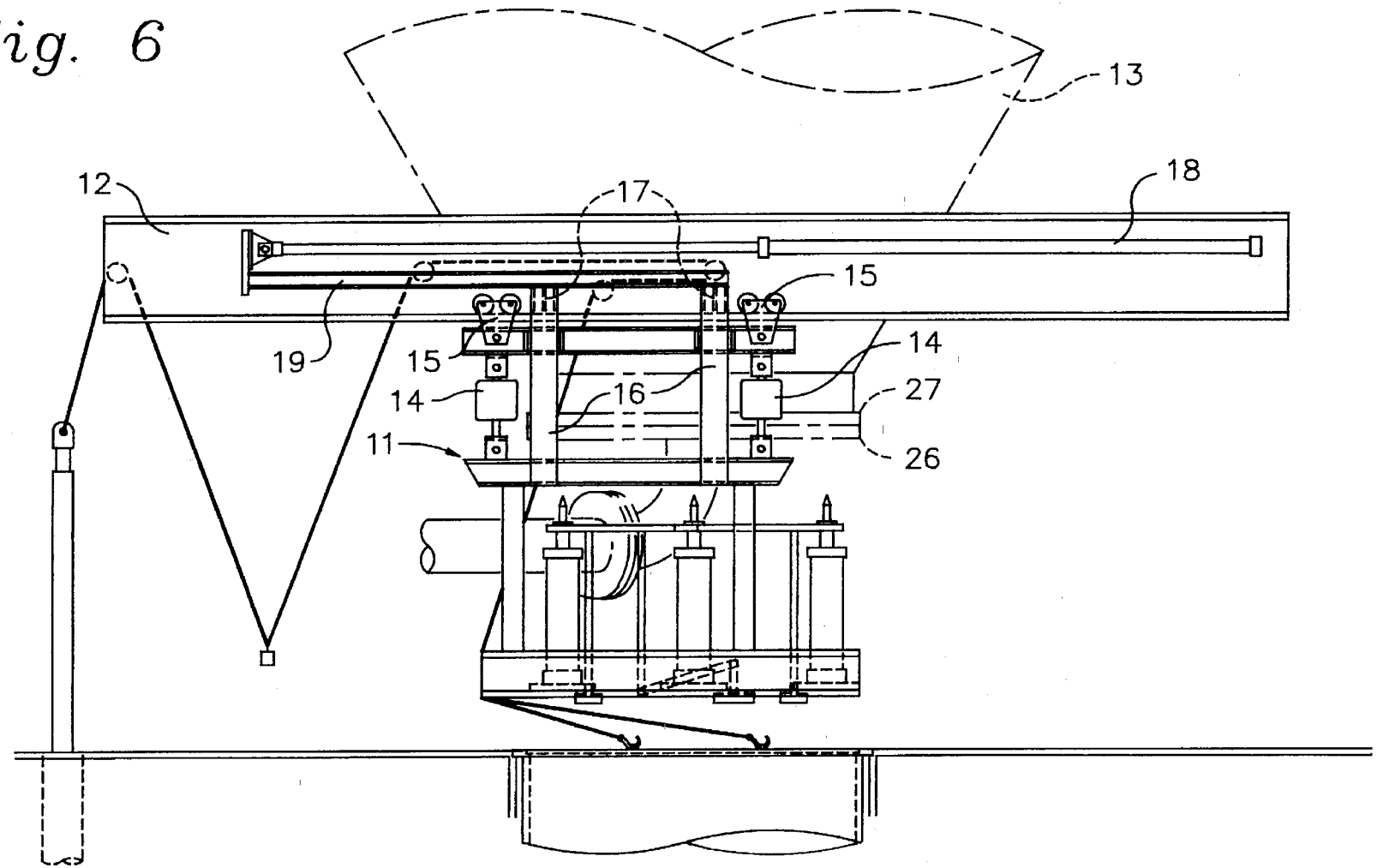
FIG. 6 is an elevational view of the carriage in operating position under the head of the coking drum.

At this point in the operating procedure the carriage 11 may be remotely moved from its retracted position as shown in FIGS. 1 and 2 to its operational position under the head of the coke drum 13 as shown in FIG. 6. At this point, springs 14 support the carriage and stops 17 clear the lower flange of beam 12 so that the carriage 11 is brought to its operating position by the remotely operated hydraulic cylinders 18 which move the carriage on the end trucks 15 by means of bar 19. As shown in FIG. 6, the drum head 26 is still attached to the bottom flange 27 of the drum. With the carriage in this working position, the bolts removed from coke charge line flanges 36 and 37 and with workers removed from the area, hydraulic cylinder 38 is remotely activated to pull the charge line elbow 34 from elbow 35 on the drum head and thus allow space for the bottom head to be removed (FIGS. 2). This remote operating procedure enables flanges 36 and 37 to be separated without danger to any operator.

Figure 7:
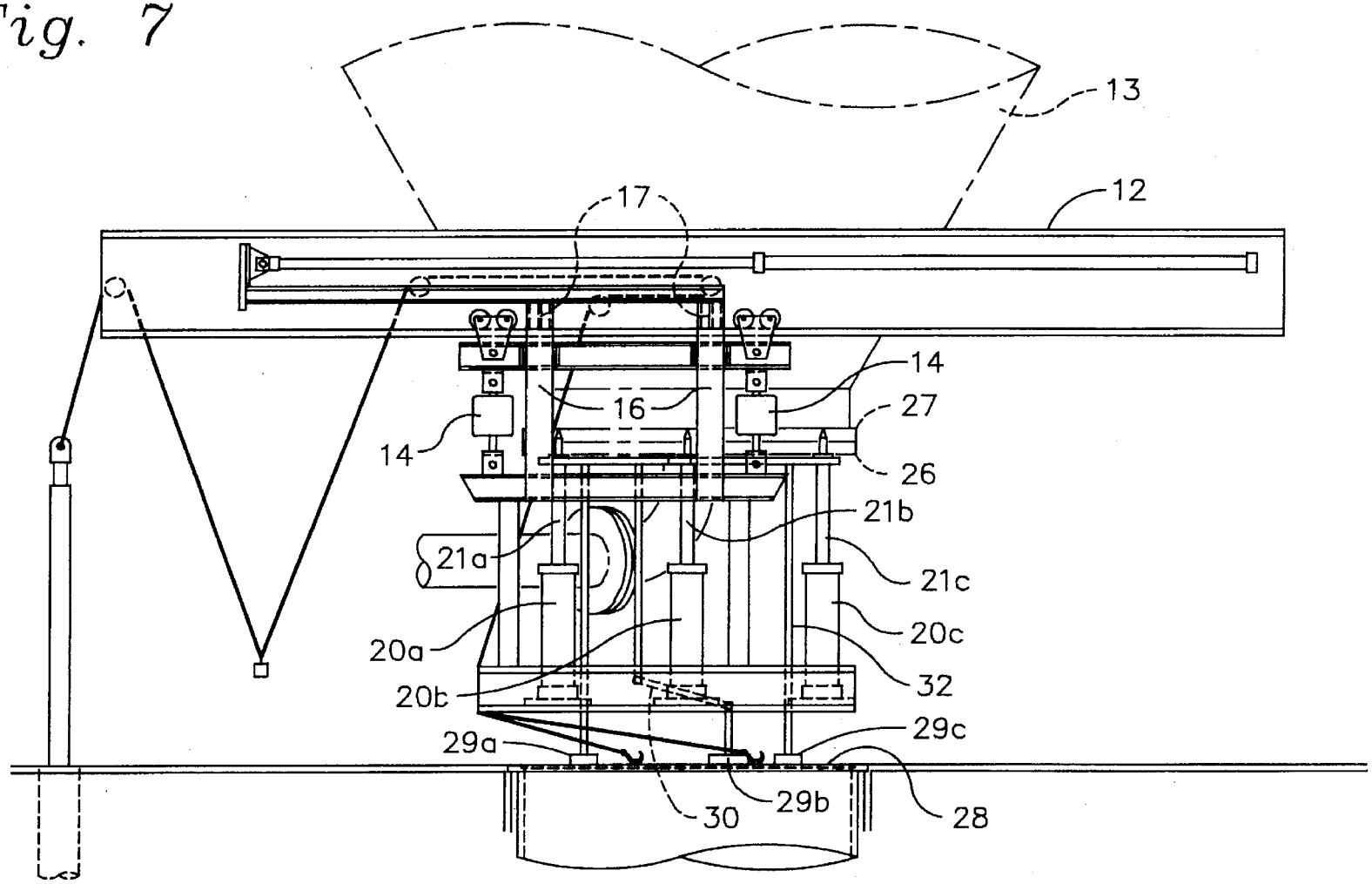
FIG. 7 is an elevation view of the carriage showing the lift cylinder in operation.

The pistons 21*a*, 21*b*, and 21*c* in the cylinders 20*a*, 20*b*, and 20*c* are now remotely raised under the head 26 to engage the three bolt holes in the head as shown in FIG. 7. The upward force of the pistons is increased to about 15 tons which compresses the springs 14 and is sufficient to overcome the force of the springs and cause the carriage assembly to drop slightly causing the stops 17 to rest directly on support beams 12. At this point, it is perfectly safe for operators to enter the area to remove the remaining bolts from the head 26 since the head will remain closed due to being tightly held in position against drum flange 27 by the upward force of pistons 21*a*, 21*b*, and 21*c*. Furthermore, there is no danger of any equipment collapse since the carriage is now supported by beams 12 which can support 75 tons.

Figure 8:
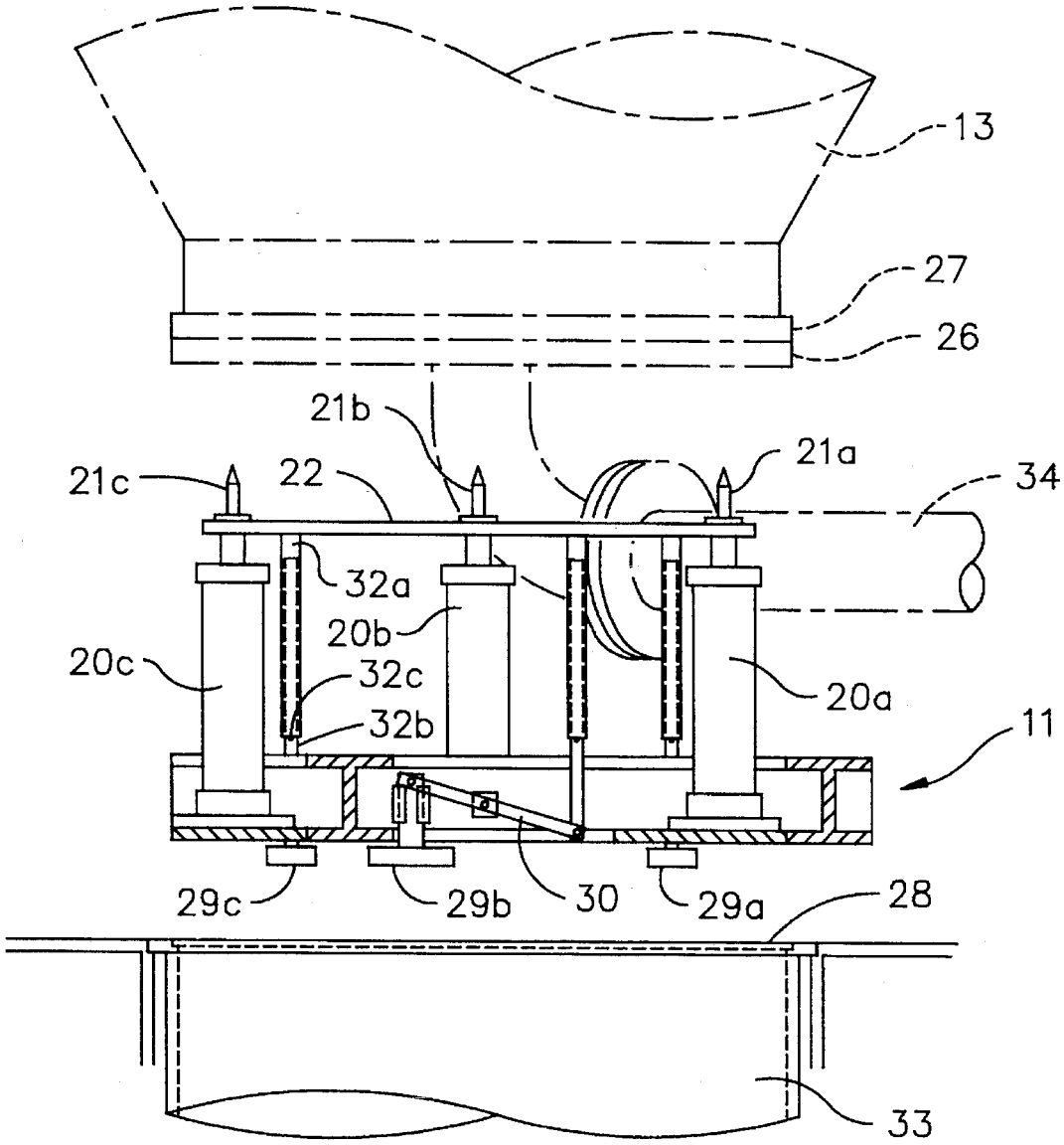
FIGS. 8, 9 and 10 are elevational views showing details of the electromagnetic system.
Figure 9:
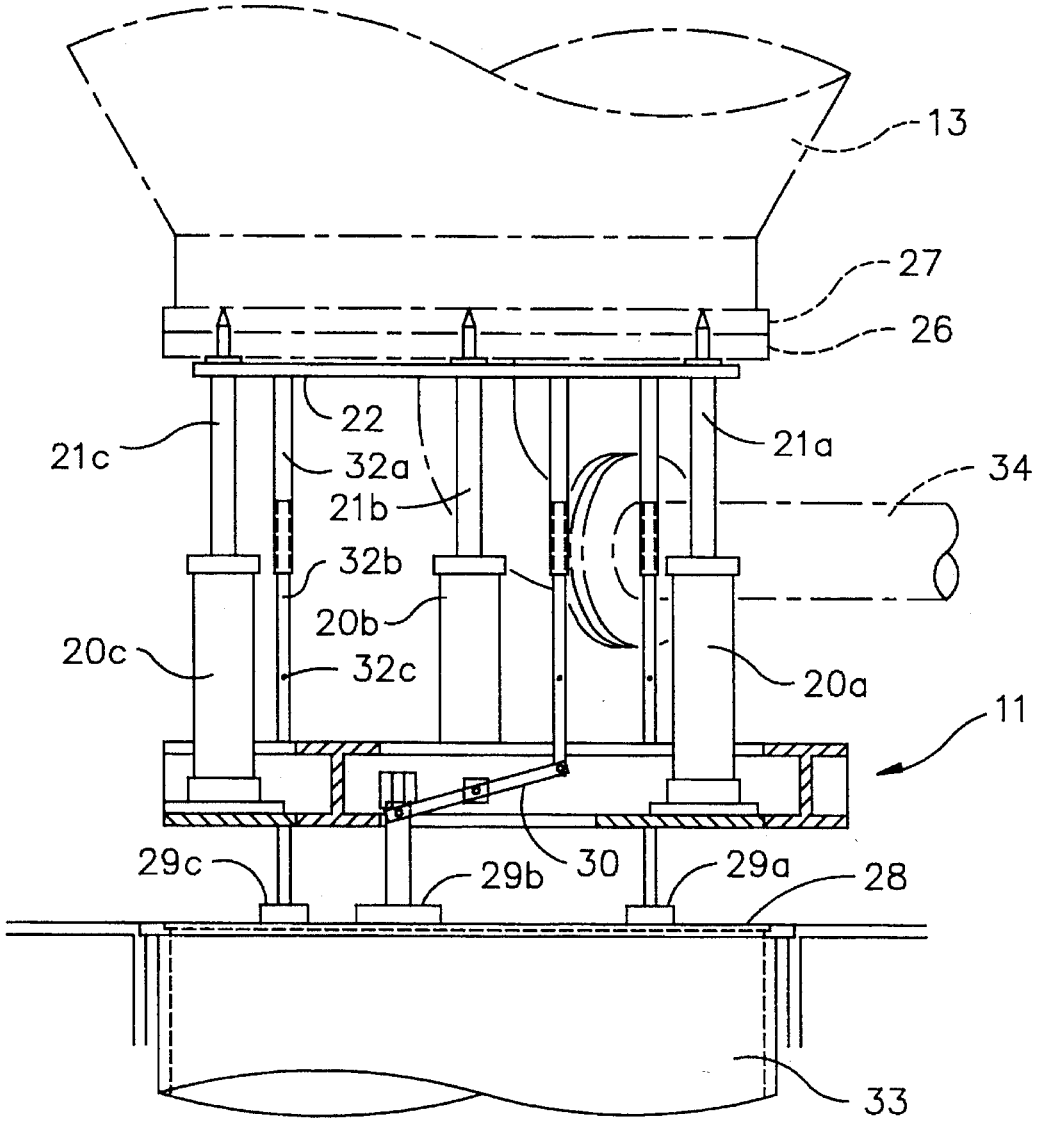
Figure 10:
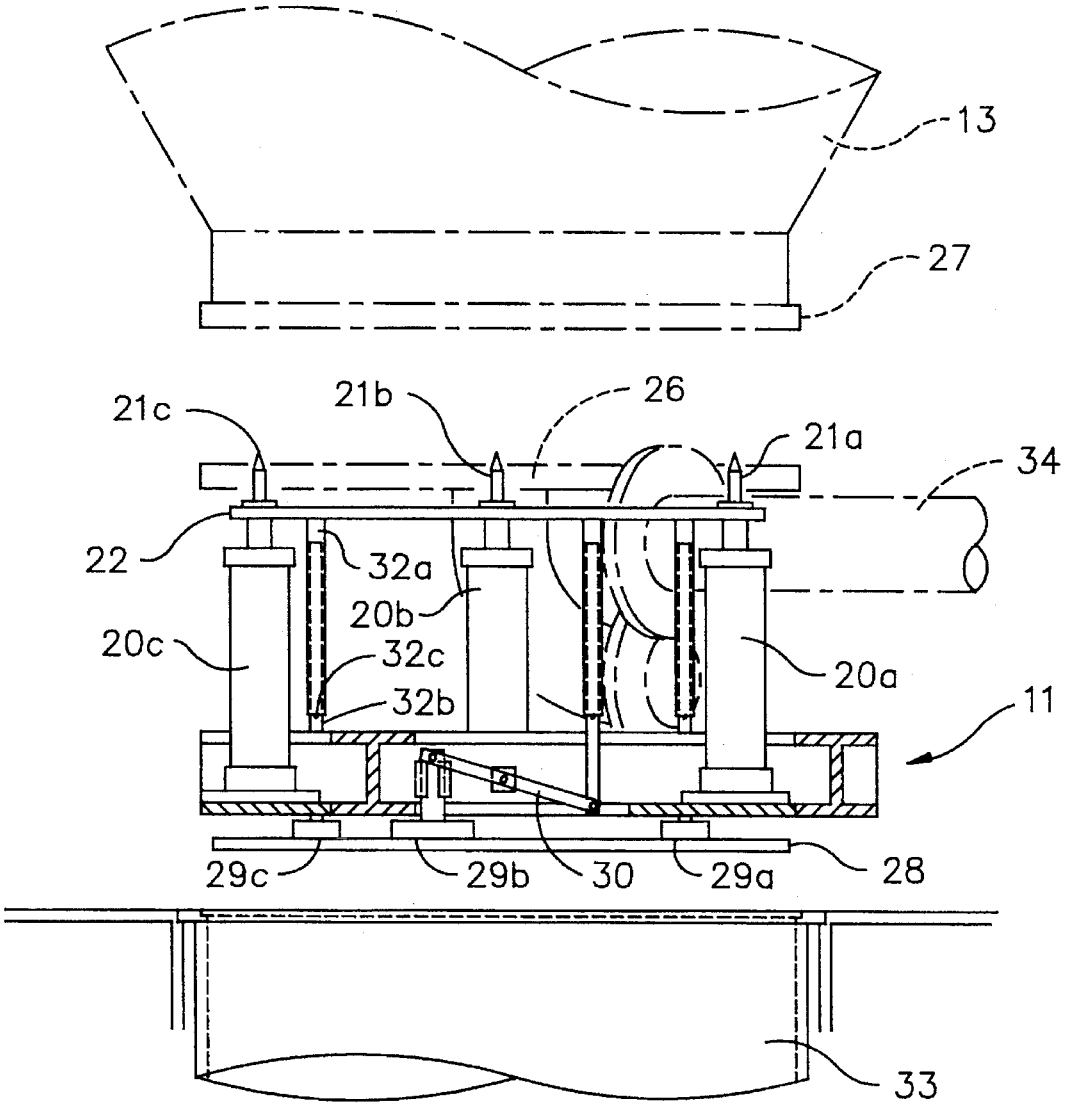

A preferred embodiment of the invention shown in FIG. 7, and in more detail in FIGS. 8 to 10 (taken through line 8—8 of FIG. 2) may be used to raise the chute cover 28 automatically by the three electromagnets 29*a*, 29*b*, and 29*c* which drop to contact the metal chute cover 28 when the head lift stabilizer channels 22 are raised with the pistons 21*a*, 21*b*, and 21*c*. A signal from proximity switches energizes the electromagnets 29*a*, 29*b*, and 29*c* whenever the coke drum head 26 is in contact with the pistons 21. As the head lift pistons are lowered (FIG. 10), the electromagnets are raised by action of 2" pipes 32*a* telescoping down over 1½" pipes 32*b* and contacting lift pins 32*c* attached to the 1½" pipes. After contact with the lift pin has been made, the downward motion of the 1½" pipes raises the electromagnets 29 and cover 28 by a lever mechanism 30 as the head is being lowered.

After removal of the last bolts from the drum head 26, the operators leave the work area and the cylinders 20 supporting the drum head 26 are remotely lowered (FIG. 10). This enables any build-up of scalding water and loose coke, which might fall from the drum as the cover is lowered, to occur in the absence of any personnel. As the head 26 in place on the carriage is remotely lowered, the compression of the springs 14 is reduced and at about 10 tons, the safety stops 17 are lifted off the main support beams 12 by the springs 14 which transfers the load to the trolleys 15. When the hydraulic cylinders are in the completely lowered position, the carriage with the lowered drum head 26 and the elbow charge line 35 attached to it is remotely moved from under the drum back to its resting position by operation of hydraulic cylinders 18. The chute cover 28 has been lifted by the electromagnets and is carried away with the carriage making the chute 33 available for lifting. FIG. 11 shows the carriage in the returned position.

In a further preferred embodiment of the invention, a chute lift arrangement shown in FIG. 11 is provided which enables the chute 33 recessed in a well beneath the coking drum to be remotely lifted from its recessed position in the floor to the drum opening, thus making it unnecessary to have personnel hook up chute hoisting equipment under hazardous conditions. In this embodiment, operators connect hooks 41 and 42 of a chute lift cable 43 to hold tabs 44 and 45 (shown in FIGS. 11 and 12). The chute lift cable 43 runs from hold tabs 44 and 45 over pulleys 46*a* to pulleys 46*b* which are anchored to the carriage at interior vertical beams 16, over pulleys 46*c* and 46*d* to a double-acting pneumatic chute lift cylinder 47 or other appropriate cable lift. The long cable and its arrangement provide sufficient slack for the carriage to move to its operating position under the drum head (FIGS. 6 and 7). Weights 48 assist in keeping the cable taut during operation. During the movement of the carriage from rest to operating position, enough slack is provided for the cable to fit around the carriage assembly (FIGS. 6 and 7). When the carriage has returned to its rest position as shown in FIG. 11, the pneumatic chute lift cylinder 47 is remotely activated which pulls the cable. The chute is thus raised to the bottom opening of the coker drum. The chute may be attached manually by two or more bolts to the drum flange (not shown). FIG. 11 shows the chute 33 raised about half-way by cable 43.

With the coke discharge chute in its raised position the coke drum may be cleaned in the usual manner and upon completion of the cleaning operation, the above-described steps are reversed to put the coking drum back in operating condition. Thus, the cylinder 47 is extended to lower chute 33 then cylinder is extended lowering chute 33 to its operating position. The drum head 26 is raised to flange 27 and workmen replace all but the nine bolts whose bolt holes contain the supporting pistons. The pistons are then lowered at which time the chute cover is also lowered and released from the electromagnets. The carriage is then returned to its retracted position and the nine missing bolts are replaced. The flange spreader cylinder 38 is extended to join flange 36 with flange 37, the bolts in these flanges are replaced and the coking drum is ready for operation.

I claim:

1. An apparatus for safely removing the drum head of a delayed coking drum, said apparatus comprising:

a carriage assembly suspended in normal mode by a spring system from overhead I-beams, which beams are designed to carry excessive loads, said spring system provided with trolleys to ride on the lower flanges of said beams under normal weight conditions, means for horizontally moving said carriage assembly supported by said trolleys along said beams by a remotely operated transport system so as to position said carriage assembly under said drum head or away from said drum head, means on said carriage assembly to remotely raise and lower said drum head when said carriage assembly is positioned under said drum head, a separate safety support system on said carriage assembly comprised of vertical beams on said carriage assembly having safety stops at the upper ends of said beams, which stops overlap the lower flanges of said overhead beams and which stops under normal conditions will be positioned a slight distance above the lower flanges of said overhead beams, said spring system being designed to support a normal load, but designed to fail under load conditions significantly exceeding a normal load, whereby under load conditions causing the spring system to fail, said carriage assembly will drop and be supported by means of said stops resting on said lower flanges of said overhead beams.

2. The apparatus of claim 1 wherein said means on said carriage assembly to remotely raise and lower said drum head comprises three triangularly arranged hydraulic cylinders which raise and lower pistons to engage bolt holes in said drum head.

3. The apparatus of claim 2 wherein said carriage assembly is adapted to lift and lower a chute cover located at floor level beneath said drum by means of electromagnets.

4. The apparatus of claim 2 further comprising a cable arrangement for lifting a chute recessed below ground level and beneath said coking drum and wherein said cable arrangement is comprised of two cables, one end of each cable being anchored to opposite sides of said chute, said cables being carried by pulleys on said carriage assembly and on said overhead beams, and being operated by a remotely activated lift cylinder.

5. In the method of removing the head of a delayed coking drum wherein said head is adapted to be fastened to a lower flange of said coking drum by a plurality of bolts, the improvement which comprises in combination:

1) removing all but a sufficient number of said bolts to keep said head in a closed position, 2) remotely moving a carriage to position said carriage underneath said drum head to support the weight of said head plus any coke resting thereon, said carriage:

having means to remotely engage said drum head to lower and raise said head, being supported on spring hangers which are supported by wheeled trolleys whose wheels rest on the lower flanges of overhead supporting I-beams which can support excessive loads, having additional vertical carriage supports whose upper ends have safety stops which overlap the lower flanges of said overhead supporting beams, said spring hangers being adapted to support a weight somewhat but not substantially more than the total weight of said carriage, said drum head, and any loose coke within said drum, said vertical carriage supports being positioned so that said stops ride slightly above said lower flanges of said supporting beams when the supporting weight of said spring hangers is not exceeded, 3) remotely raising said drum head engaging means on said carriage to engage said drum head and applying sufficient force on said head to compress said spring hangers so that said carriage is lowered and thereby supported by said stops resting on the lower flanges of said supporting beams, 4) removing the remaining bolts from said drum head, clearing the work area around the drum head of personnel and remotely lowering said head, thereby allowing any water and loose coke in the drum to fall out, and thereafter allowing operators to enter the work area, 5) whereby, if the supporting weight of said spring hanger is exceeded while operators are in the work area, said carriage drops and said stops on the ends of said carriage supports also drop to rest on said lower flanges of said supporting beams, thereby supporting said carriage and eliminating any hazard in the work area.

6. The method of claim 5 wherein said drum head engaging means comprises three triangularly arranged hydraulic cylinders which raise and lower pistons to engage bolt holes in said drum head.

7. The method of claim 6 wherein said carriage is adapted by means of electromagnets to lift and lower a chute cover located at floor level beneath said drum.

8. The method of claim 7 wherein said carriage includes a cable arrangement for lifting a chute recessed below ground level and beneath said coking drum, said cable arrangement being comprised of two cables, one end of each cable being anchored to opposite sides of said chute, said cables being carried on said carriage and on said overhead supporting beams, and being operated by a remotely activated cable lift, whereby when said drum head has been removed from said coking drum and said chute cover has been placed in position beneath said drum head, and said carriage has carried said drum head and said chute cover from under said drum, said cable lift is activated to raise said chute.

9. The method of claim 8 wherein said cable lift is a remotely controlled pneumatic cylinder.

10. The method of claim 6 wherein after raising said drum head engaging means and applying sufficient force to cause said carriage to be supported by said safety stops on said overhead beams, the bolts are removed from flanges connecting two elbows of a coke charge line and said elbows are separated by activating a hydraulic cylinder attached by a rod and collar to one of said elbows.

* * * * *